US006122793A

United States Patent [19]

Pao

[11] Patent Number: 6,122,793

[45] Date of Patent: Sep. 26, 2000

[54] OVERSHOE FOR SLIDING ON FLOOR

[76] Inventor: Edward Pao, 25425 Hidden Mesa Rd., Monterey, Calif. 93940

[21] Appl. No.: 09/170,371

[22] Filed: Oct. 13, 1998

Related U.S. Application Data

[60] Provisional application No. 60/082,924, Apr. 24, 1998.

[51] Int. Cl.[7] ..... A47L 13/20; A47L 13/282

[52] U.S. Cl. ..... 15/227; 36/7.1 R; 36/113

[58] Field of Search ..... 15/209.1, 227, 15/228; 36/7.1 R, 7.2, 9 R, 113, 15, 100

[56] References Cited

U.S. PATENT DOCUMENTS

| | | | |
|---|---|---|---|
| 599,495 | 2/1898 | Durel et al. | 15/227 |
| 2,784,436 | 3/1957 | Peterson | 15/227 |
| 3,362,775 | 1/1968 | Muecke | 15/227 |
| 3,460,182 | 8/1969 | Grande, Jr. | 15/227 |
| 3,526,014 | 9/1970 | Edwards | 15/227 |
| 5,012,544 | 5/1991 | Verry | 15/228 |
| 5,173,985 | 12/1992 | Palmer | 15/227 |
| 5,473,788 | 12/1995 | Aragona | 15/227 |
| 5,596,787 | 1/1997 | Stevens et al. | 15/228 |
| 5,613,897 | 3/1997 | Thompson, Jr. . | |
| 5,644,813 | 7/1997 | Puskas . | |
| 5,735,805 | 4/1998 | Wasserman et al. | 36/15 |

FOREIGN PATENT DOCUMENTS

| | | |
|---|---|---|
| 101582 | 10/1923 | Germany . |
| WO 90/05478 | 5/1990 | WIPO . |

*Primary Examiner*—Randall E. Chin
*Attorney, Agent, or Firm*—Jack Lo

[57] ABSTRACT

An overshoe is comprised of a plate with a plurality of straps attached to its edges. A cushion is removably attached to a bottom of the plate with hook-and-loop fasteners. The cushion is preferably comprised of loose absorbent fibers attached all across the bottom surface of a fabric substrate. A soft boot preferably made of a thick absorbent fabric is arranged for wrapping around the plate and the cushion. A conventional shoe is preferably worn on the foot prior to wearing the overshoe. To use, the cushion is attached to the bottom of the plate, which is strapped onto the shoe. The cushion is preferably much wider than the shoe, so that it projects substantially beyond the sides of the shoe. The boot is worn over the shoe, the plate, and the cushion. A small amount of cleaning fluid is applied to a floor, which is cleaned by moving the overshoe across it with a skating motion. Heavy pressure is automatically exerted on the overshoe by the user's weight for effective cleaning.

10 Claims, 1 Drawing Sheet

OVERSHOE FOR SLIDING ON FLOOR

CROSS REFERENCE TO RELATED APPLICATIONS

The subject matter disclosed herein has been submitted in provisional application 60/082,924, filed Apr. 24, 1998.

BACKGROUND OF THE INVENTION

1. Field of the Invention

This invention relates generally to overshoes for cleaning floors.

2. Prior Art

A conventional mop is comprised of a mop head made of a resilient, absorbent material attached to a long handle. Liquid is soaked into the mop head, which is pushed about on a floor by grasping the handle. The mop head must be pressed firmly against the floor, but applying enough pressure with the arms and hands is difficult, especially for women. The user's back must be bent to help exert pressure. Therefore, cleaning the floor with a conventional mop requires a great deal of effort and time, which result in fatigue and soreness. Further, a large amount of liquid must be applied to the floor, which requires carrying a heavy bucket of the liquid, and a long time is required to allow the floor to dry.

U.S. Pat. No. 5,644,813 to Puskas shows an overshoe mop comprised of a resilient pad attached to the bottom of a soft boot worn over a shoe. The floor is moped by skating across the floor with the overshoe mop on one or both feet. The soft boot does not secure the pad well enough, so that the pad can easily slip out of position under the shoe during use. The single layer of absorbent material can only absorb a small amount of liquid. Further, the pad cannot reach into corners or tight areas, such as under slightly raised cabinets, book shelves, etc. U.S. Pat. No. 5,613,897 to Thompson, Jr. shows a foot pad for being attached to a shoe with a single strap or adhesive. The single strap cannot secure the pad well enough, and the adhesive can only be used once, so that the device is impractical.

OBJECTS OF THE INVENTION

Accordingly, objects of the present overshoe are:

- to effectively clean a floor with reduced physical exertion and in reduced time;
- to clean a floor with very little liquid to reduce consumption of resources and reduce drying time;
- to be able to reach into corner or tight areas;
- to free the hands for other tasks while cleaning the floor; and
- to be washable and reusable.

Further objects of the present invention will become apparent from a consideration of the drawings and ensuing description.

BRIEF SUMMARY OF THE INVENTION

An overshoe is comprised of a plate with a plurality of straps attached to its edges. A cushion is removably attached to a bottom of the plate with hook-and-loop fasteners. The cushion is preferably comprised of loose absorbent fibers attached all across the bottom surface of a fabric substrate. A soft boot preferably made of a thick absorbent fabric is arranged for wrapping around the plate and the cushion. A conventional shoe is preferably worn on the foot prior to wearing the overshoe. To use, the cushion is attached to the bottom of the plate, which is strapped onto the shoe. The cushion is preferably much wider than the shoe, so that it projects substantially beyond the sides of the shoe. The boot is worn over the shoe, the plate, and the cushion. A small amount of cleaning fluid is applied to a floor, which is cleaned by moving the overshoe across it with a skating motion. Heavy pressure is automatically exerted on the overshoe by the user's weight for effective cleaning.

DRAWING REFERENCE NUMERALS

| | |
|---|---|
| 10. Plate | 11. Front Straps |
| 12. Rear Straps | 13. Heel Strap |
| 14. Cushion | 15. Fasteners |
| 16. Fasteners | 17. Fibers |
| 18. Substrate | 19. Boot |
| 20. Bottom | 21. Opening |
| 22. Elastic Rim | 23. Shoe |
| 24. Cleaning Fluid | |

DETAILED DESCRIPTION OF THE INVENTION

Figure 1:
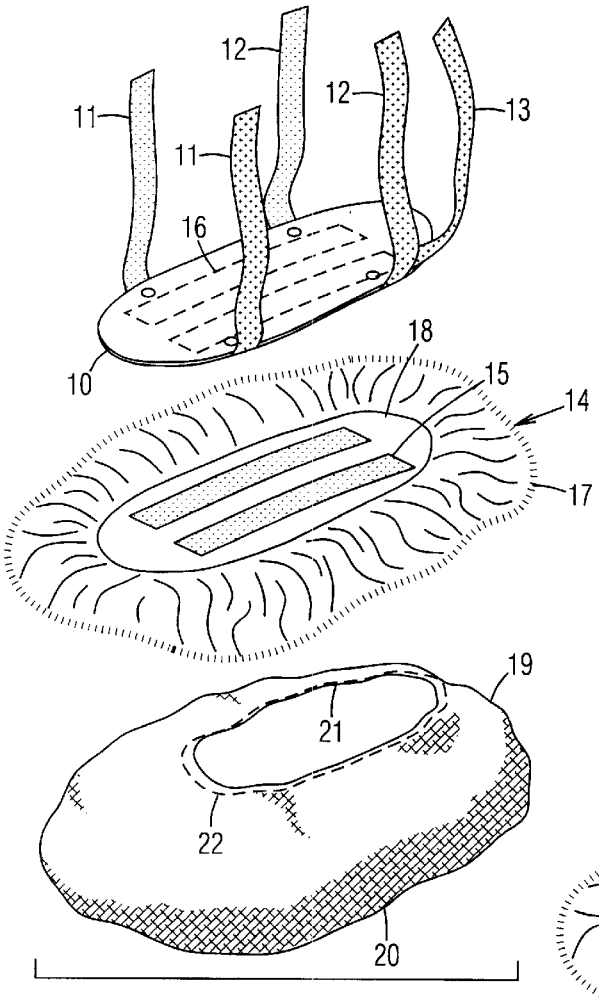
FIG. 1 is a side perspective exploded view of the present overshoe.

A preferred embodiment of the overshoe is shown in the exploded view in FIG. 1. It includes a plate 10 with a pair of front straps 11 attached to its opposite edges adjacent its front, a pair of rear straps 12 attached to its opposite edges adjacent its rear, and a heel strap 13 attached to one of rear straps 12. Straps 11–13 are preferably hook-and-loop fastener straps. A cushion 14 is arranged for being removably attached to a bottom of plate 10 with fasteners 15 fixedly attached on a top of cushion 14 and fasteners 16 fixedly attached to a bottom of plate 10. Fasteners 15 and 16 are preferably hook-and-loop fasteners. Cushion 14 preferably comprises loose absorbent fibers 17 attached all across the bottom surface of a fabric substrate 18. A boot 19 is arranged for wrapping around plate 10 and cushion 14. Boot 19 includes a closed bottom 20 and a top opening 21 with an elastic rim 22. Boot 19 is preferably made of a thick absorbent fabric.

Figure 2:
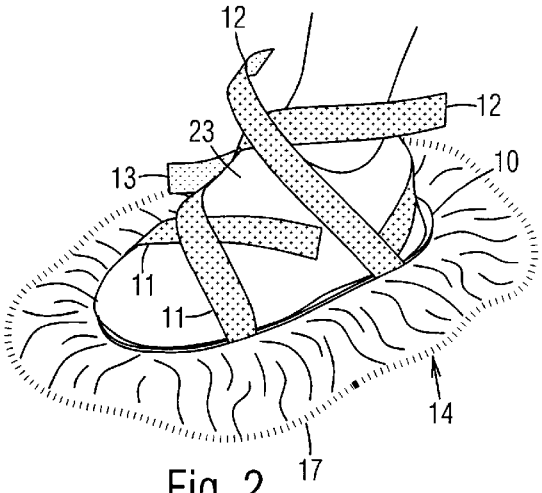
FIG. 2 is a side perspective view of the overshoe partially assembled on a foot.
Figure 3:
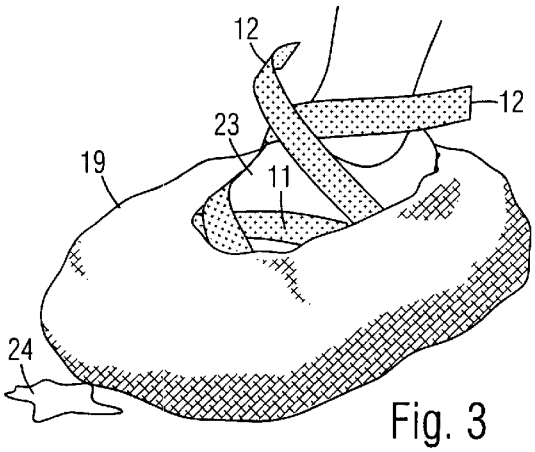
FIG. 3 is a side perspective view of the overshoe fully assembled on the foot.

The overshoe is shown partially assembled on a foot in FIG. 2. A conventional shoe 23 is preferably worn on the foot prior to wearing the overshoe. Cushion 14 is attached to the bottom of plate 10, and plate 10 is strapped onto shoe 23. Cushion 14 is preferably much wider than shoe 23, so that it projects substantially beyond the sides of shoe 23. As shown in FIG. 3, the foot, shoe 23, plate 10 (FIG. 2), and cushion 14 (FIG. 2) are inserted into boot 19. When fully assembled, cushion 14 is positioned between shoe 23 and boot 19. The sides of the overshoe project beyond the sides of shoe 23 when boot 19 is worn. The user can wear two overshoes on both feet for faster cleaning if desired.

To use, a small amount of a cleaning fluid 24, which is preferably a chemical cleanser, is applied onto a floor, and the overshoe is rubbed over fluid 24 by moving the foot back and forth. The small amount of cleaning fluid used makes drying the floor very easy. When two overshoes are worn, they are rubbed over the floor with a sliding or skating motion. The plurality of straps ensure that plate 10 and cushion 14 are securely attached to shoe 23, even during vigorous movements. The overshoe is automatically pressed onto the floor under great pressure by the weight of the user to quickly rub out dirt, without any deliberate effort from the user to apply pressure. The pressure is evenly transmitted from shoe 23 to the entire bottom surface of boot 19 through cushion 14. The overshoe is substantially wider than shoe 23, so that the foot is cushioned from shock when rubbed against a wall or furniture, such as when the overshoe is used on the edge of a floor or around furniture. The portion of the overshoe that projects beyond the sides of shoe 23 can be inserted under furniture for cleaning hard-to-reach areas. Boot 19 and cushion 14 are preferably made of thick absorbent materials, so that they can absorb enough fluid to dry the floor. After use, cushion 14 can be removed from plate 10 for being washed together with boot 19.

SCOPE

Although the above descriptions are specific, they should not be considered as limitations on the scope of the invention, but only as examples of the embodiments. Many substitutes and variations are possible within the teachings of the invention. For example, straps 11–13 may be comprised of other types of straps, such as straps with buckles. Heel strap 13 may be attached to plate 10 adjacent one of rear straps 12. Cushion 14 may be comprised of other materials, such as foam, a thickly padded fabric mat, etc. Boot 19 may be made of any suitable flexible, tough, and absorbent material. Fasteners 15 and 16 may be comprised of other types of fasteners, such as snaps. Straps 11–13 can be attached directly to cushion 14. Instead of cleaning, the overshoe can be used for other purposes, such as skating across a floor simply for fun. Therefore, the scope of the invention should be determined by the appended claims and their legal equivalents, not by the examples given.

I claim:

1. An overshoe for sliding on a floor, comprising:

a resilient absorbent cushion for being positioned under a shoe worn on a user;

a plurality of straps connected to said cushion for securely strapping across a top of said shoe; and a soft absorbent boot with a closed bottom and a top opening, said boot being worn around said cushion, said boot for being worn around said shoe.

2. The overshoe of claim 1, wherein said straps include hook-and-loop fastening means for attaching to each other.

3. The overshoe of claim 1, wherein said straps are comprised of a pair of front straps connected to said cushion for securely strapping across said top of said shoe near a front thereof, a pair of rear straps connected to said cushion for securely strapping across said top of said shoe immediately in front of a leg of said user; and a heel strap connected to said cushion for strapping across a heel of said shoe, a distal end of said heel strap connecting with one of said rear straps.

4. The overshoe of claim 1, wherein said cushion is comprised of loose absorbent fibers attached across a bottom of a fabric substrate for mopping a floor.

5. The overshoe of claim 1, wherein said overshoe is wide enough for projecting substantially beyond said shoe for reaching into corners and tight areas when used for mopping a floor.

6. An overshoe for sliding on a floor, comprising:

a plate for being positioned under a shoe worn on a user;

a plurality of straps attached to said plate for securely strapping across a top of said shoe;

a resilient absorbent cushion removably attached under said plate; and a soft absorbent boot with a closed bottom and a top opening, said boot being worn around said cushion and said plate, said boot for being worn around said shoe.

7. The overshoe of claim 6, wherein said straps include hook-and-loop fastening means for attaching to each other.

8. The overshoe of claim 6, wherein said straps are comprised of a pair of front straps connected to said cushion for securely strapping across said top of said shoe near a front thereof; a pair of rear straps connected to said cushion for securely strapping across said top of said shoe immediately in front of a leg of said user; and a heel strap connected to said cushion for strapping across a heel of said shoe, a distal end of said heel strap connecting with one of said rear straps.

9. The overshoe of claim 6, wherein said cushion is comprised of loose absorbent fibers attached across a bottom of a fabric substrate for mopping a floor.

10. The overshoe of claim 6, wherein said overshoe is wide enough for projecting substantially beyond said shoe for reaching into corners and tight areas when used for mopping a floor.

* * * * *